US006007393A

United States Patent [19]

Choiniere et al.

[11] Patent Number: 6,007,393

[45] Date of Patent: Dec. 28, 1999

[54] SURFBOARD

[75] Inventors: Gilles Choiniere; Marc Nadeau; Bernard Laplante, all of Granby, Canada

[73] Assignee: Quebec Inc., Granby, Canada

[21] Appl. No.: 09/101,606

[22] PCT Filed: Jan. 17, 1997

[86] PCT No.: PCT/CA97/00034

§ 371 Date: Jul. 13, 1998

§ 102(e) Date: Jul. 13, 1998

[87] PCT Pub. No.: WO97/27100

PCT Pub. Date: Jul. 31, 1997

[30] Foreign Application Priority Data

Jan. 26, 1996 [GB] United Kingdom ..... 9601606

[51] Int. Cl.[6] ..... B63B 35/79; B63B 1/32

[52] U.S. Cl. ..... 441/74; 114/288

[58] Field of Search ..... 441/74, 79, 68; 114/288, 290, 291

[56] References Cited

U.S. PATENT DOCUMENTS 850,034 4/1907 Miller ..... 114/288

4,894,035 1/1990 Pia ..... 441/79

5,238,434 8/1993 Moran ..... 441/74

5,339,761 8/1994 Huang ..... 114/274

5,351,641 10/1994 Robson ..... 114/288

*Primary Examiner*—Sherman Basinger

*Assistant Examiner*—Patrick Muldoon

*Attorney, Agent, or Firm*—F. Martineau

[57] ABSTRACT

The bottom surface of the surfboard has a set of transverse ridges which are bowed away from the front of the surfboard, which are symmetrical relative to the longitudinal axis of the board. A channel extends across the edge surface of these ridges and are aligned along the board longitudinal axis. In motion, the moving water not only strikes the rear edge face of the surfboard but also the rear faces of each ridge, thereby increasing its propelling efficiency relative to surfboards devoid of such ridges. A second and a third sets of transverse ridges may be formed in water pockets made on opposite lateral side surfaces of the surfboard. These second and third ridge pockets assist in self-straightening the surfboard should the latter accidentally swerve at least slightly transversely from the general axial direction of displacement.

14 Claims, 5 Drawing Sheets

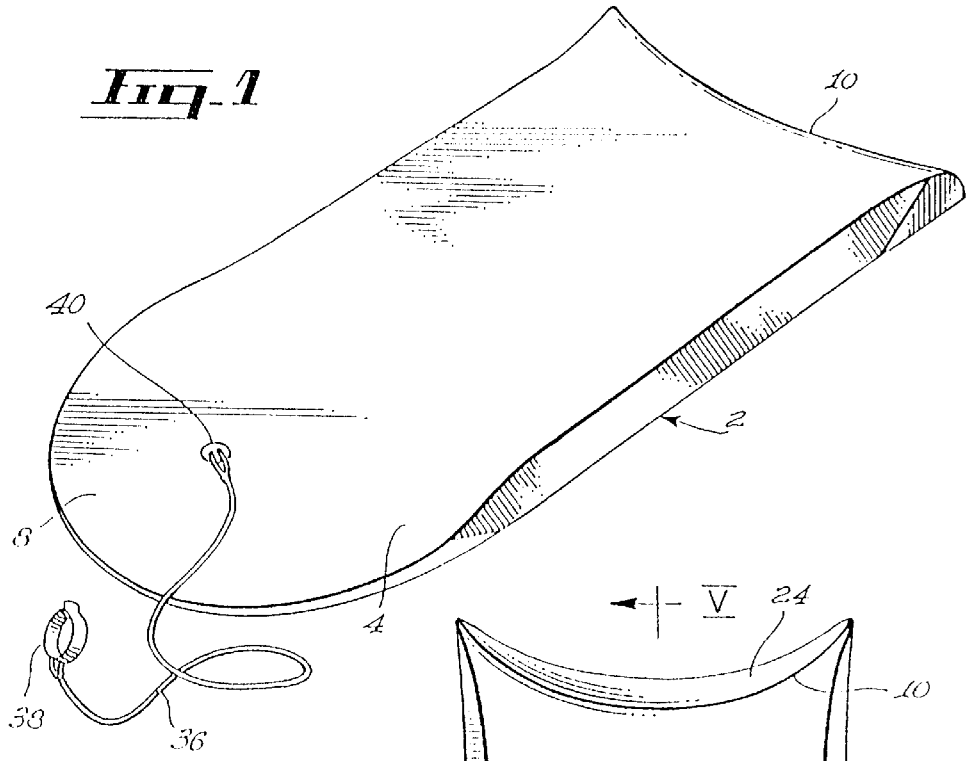
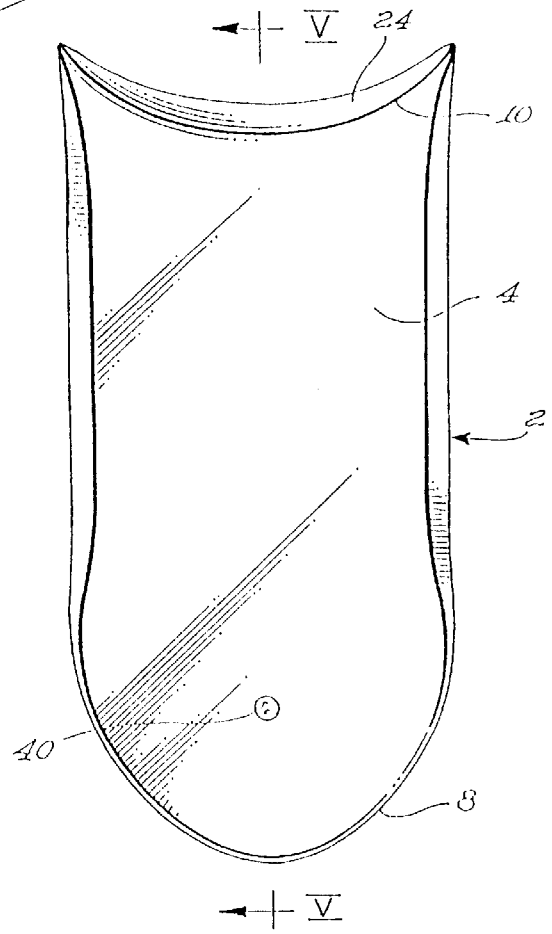
Fig. 2

Fig. 3
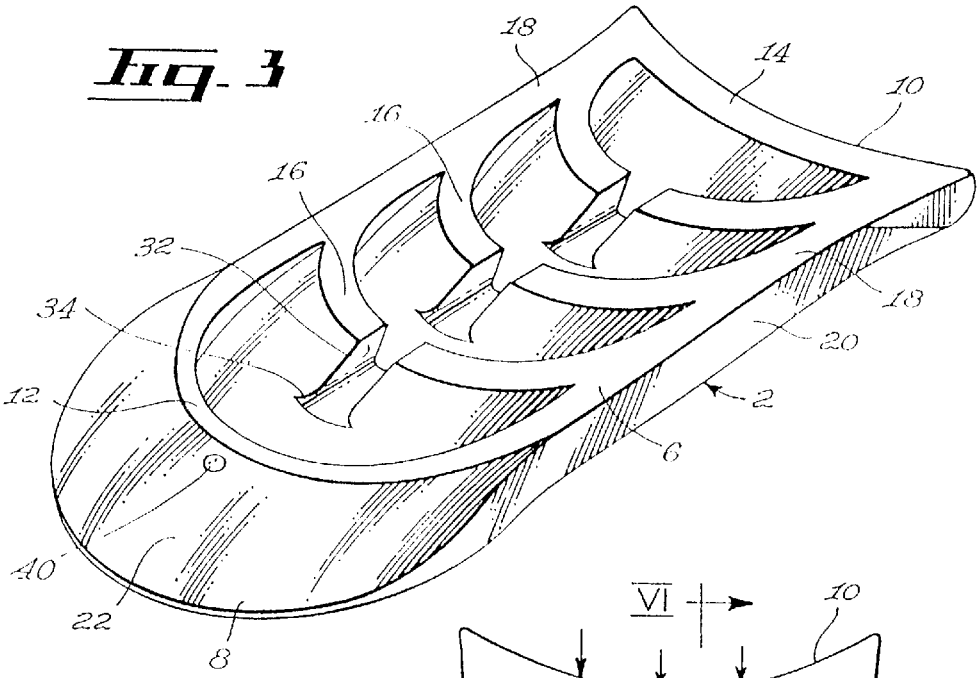
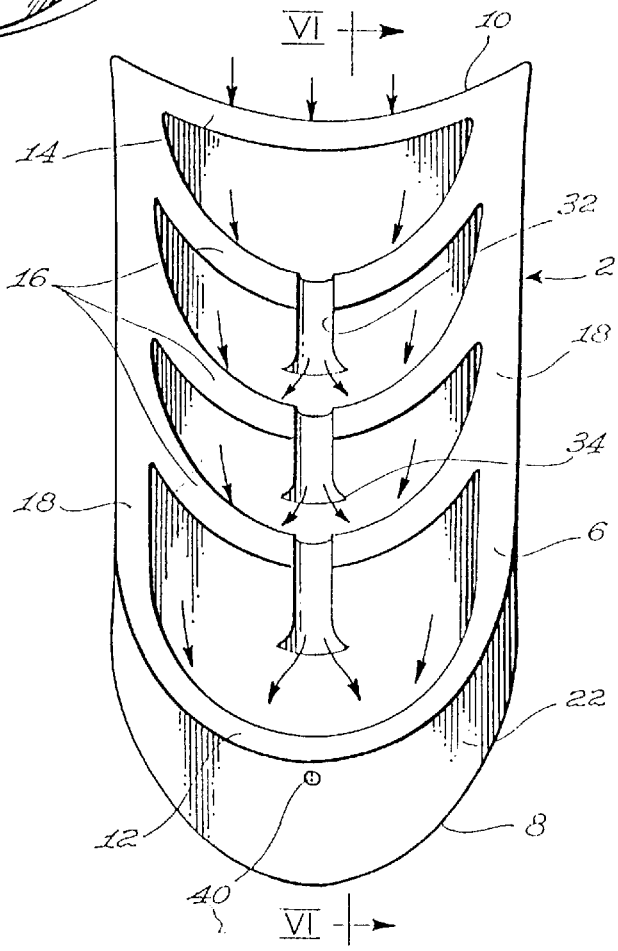
Fig. 4

SURFBOARD

FIELD OF THE INVENTION

The present invention relates to surfboards.

BACKGROUND OF THE INVENTION

Conventional surfboards, used for riding waves, are formed of an elongated buoyant board having a smooth surface with a pointed bow and a generally straight transverse stern. The sportsman is forwardly propelled by the breaking waves while standing up or lying on his chest on the board.

One partially improved surfboard is shown in the international application laid open under the No. WO 90/03306 on Apr. 5, 1990 in the name of Marica ION. The ION application shows a surfboard having arcuate, frontwardly convex ridges on its underface. Each ridge has a hydrodynamic shape more particularly defining a rearwardly sloping front face and an inclined or upright rear face. The surfboard is destined to floatingly slide upon the water surface mainly by resting on the front surface of the ridges, while rearwardly oncoming water will hit the rear surface of the ridges to frontwardly drive the surfboard.

It has been found by the inventors that the directional stability and the propelling efficiency of conventional surfboards could be improved.

OBJECTS OF THE INVENTION

It is therefore the general object of the present invention to provide a surfboard having improved propelling efficiency and also improved directional stability.

Another object of the present invention is the provision of a surfboard having a plurality of transverse ridges formed by grooves in its bottom surface to increase the surfboard faces exposed to the forwardly moving water, said ridges being arcuate and bowed away from the front end of the surfboard provide directional stability.

A further object of the invention is to provide a pair of additional sets of ridges on the opposite lateral side surfaces of the board, to improve self-straightening of the board in motion upon the board accidentally swerving out of its main axial direction of displacement.

Another object of the present invention is to provide a surfboard having these improved characteristics and which is yet of simple and inexpensive construction.

SUMMARY OF THE INVENTION

The surfboard of the present invention comprises an elongated buoyant body having top, bottom, and opposite one and another lateral side surfaces, a longitudinal axis and a front and a rear end, said body having a first set of arcuate, transverse ridges formed by grooves in said bottom surface, said ridges including a frontmost ridge, a rearmost ridge and intervening ridges, all of said ridges being frontwardly convex, symmetrical relative to said longitudinal axis and spaced one from the other longitudinally of said body, said ridges each having a frontmost leading face;

characterized in that at least some of said ridges are formed with a transversal channel extending through their leading face, said channels being aligned along said longitudinal axis.

Preferably, each said channel flares at its front end.

Preferably, each groove is defined by said leading face of any given ridge and by the back face of an adjacent preceding ridge, each groove being of V-shaped cross-section, said leading and back faces being upwardly and frontwardly inclined.

Preferably, each said ridge leading face defines a substantially flat lower edge surface forming part of said bottom surface.

Preferably, the apices of said grooves are substantially, equally dowmwardly spaced from said top surface.

Preferably, said rearmost ridge has a rear face being adjacent to said bottom surface and substantially normal thereto at the junction of said rearmost ridge with said bottom surface, said rearmost ridge being of increasing inclination while approaching said top surface, thus defining a rearwardly convex shape.

Preferably, said frontmost ridge leading face forms the bow surface of said body, said bow surface being convex in planes normal and parallel to said top and bottom surfaces.

Preferably, each said transverse ridge of said first set of ridges has a lower edge, said one and another lateral side surfaces being each provided with a longitudinal ridge having a lower surface merging with the lower edge of said first set of transverse ridges, said longitudinal ridges merging with each other at said front end of the surfboard body.

Preferably, said rearmost ridge has a rear face being adjacent to said bottom surface and substantially normal thereto at the junction of said rearmost ridge with said bottom surface, said rearmost ridge being of increasing inclination while approaching said top surface, thus defining a rearwardly convex shape.

Preferably, said frontmost ridge leading face forms the bow surface of said body, said bow surface being convex in planes normal and parallel to said top and bottom surfaces.

Preferably, said one and another lateral side surfaces are each provided with a longitudinal ridge having a lower surface merging with the lower edge surface of said transverse ridges, said longitudinal ridges merging with each other at said front end of the surfboard body.

Preferably, the surfboard further includes a second and a third set of arcuate transverse ridges formed by grooves made in said one and another side surfaces respectively, said ridges of the second and third set including a frontmost ridge, a rear ridge and at least one intervening ridge, all of said ridges being arcuate, frontwardly convex and spaced one from the other longitudinally of said body, said ridges having respective frontmost leading faces defining lower edges arcuately converging toward one another but extending short of said longitudinal ridges merging at the front end of the surfboard body.

Preferably, each groove of said side surfaces is defined by the leading face of any given ridge and by the back face of an adjacent preceding ridge, each groove being of V-shaped cross-section; a groove further rearwardly depending from said rearmost ridges of each of said first, second and third sets of arcuate transverse ridges, wherein three coextensive groove mouths are defined at the rear end of the surfboard body.

The present invention also relates to a surfboard comprising an elongated buoyant body having top, bottom, and opposite one and another lateral side surfaces, a longitudinal axis and a front and a rear end, said body having a first set of arcuate, transverse ridges formed by grooves in said bottom surface, said ridges including a frontmost ridge, a rearmost ridge and intervening ridges, all of said ridges being frontwardly convex, symmetrical relative to said longitudinal axis and spaced one from the other longitudinally of said body, said ridges each having a frontmost leading face defining a lower edge;

characterized in that said side surfaces are each provided with a longitudinal ridge having a lower edge, the lower edges of said longitudinal ridges merging with the lower edges of said frontmost, rearnost and intervening ridges, said longitudinal ridges of said side surfaces merging at said front end of the surfboard body.

In this case, the surfboard preferably further includes a second and a third set of arcuate transverse ridges formed by grooves made in said one and another side surfaces respectively, said ridges of the second and third set including a frontmost ridge, a rearmost ridge and at least one intervening ridge, all of said ridges being frontwardly convex and spaced one from the other longitudinally of said body, said frontmost ridges of the second and third set of ridges arcuately converging toward one another but extending short of said longitudinal ridges merging at the front end of the surfboard body.

DESCRIPTION OF THE DRAWINGS

In the annexed drawings:

FIG. 1 is perspective view of the deck of a first embodiment of surfboard according to the invention;

FIG. 2 is top plan view of the surfboard of FIG. 1;

FIG. 3 is a bottom perspective view of the surfboard of FIG. 1;

FIG. 4 is a bottom plan view of the first embodiment of surfboard, with the arrows suggesting the waterflow through the underface grooves;

DETAILED DESCRIPTION OF THE PREFERRED EMBODIMENT

Figure 5:
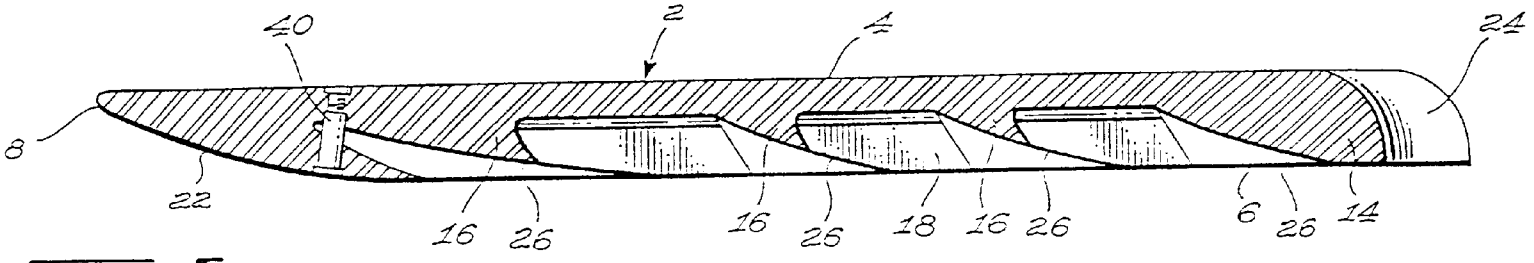
FIGS. 5 and 6 are enlarged longitudinal sections taken along V—V of FIG. 2 and VI—VI of FIG. 4 respectively.
Figure 6:
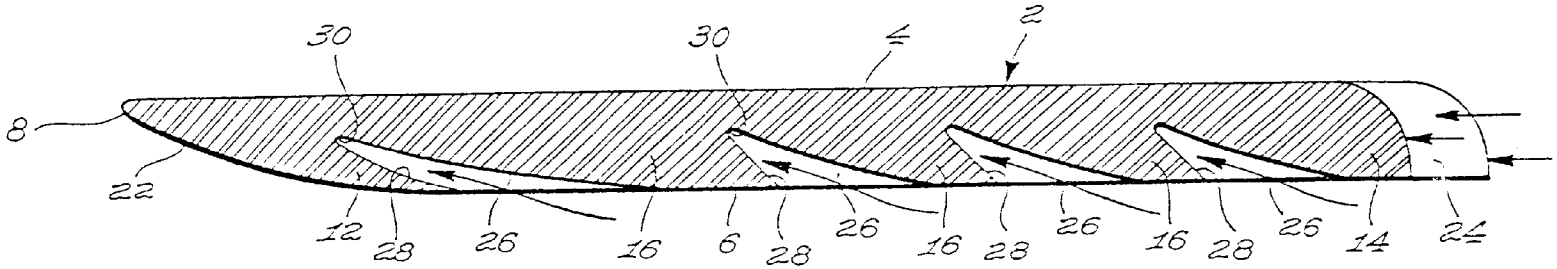
Figure 7:
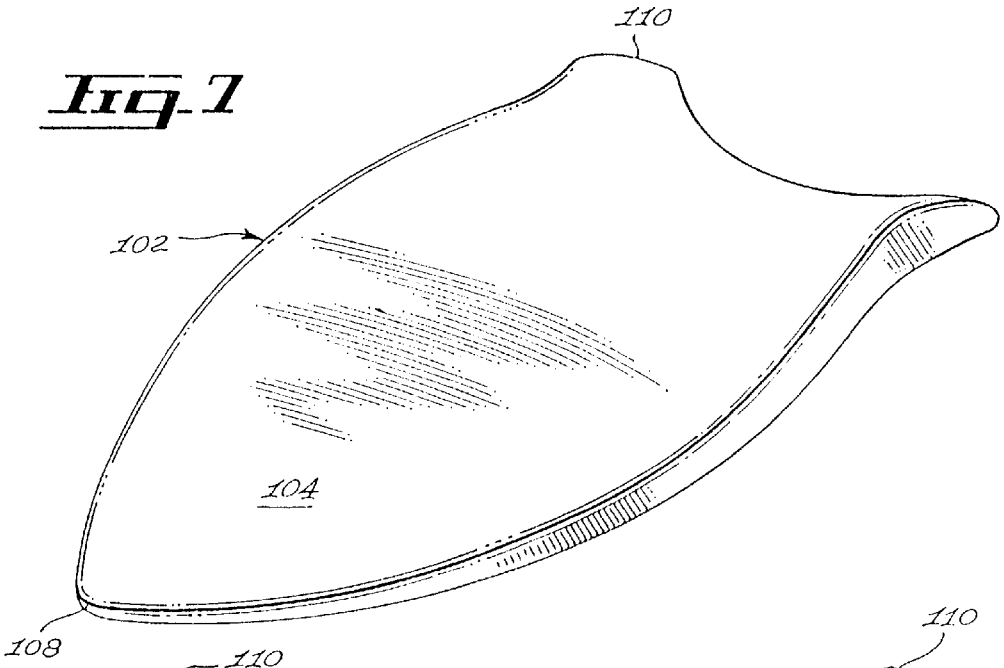
FIG. 7 is a perspective view of the deck of an alternate embodiment of surfboard.
Figure 8:
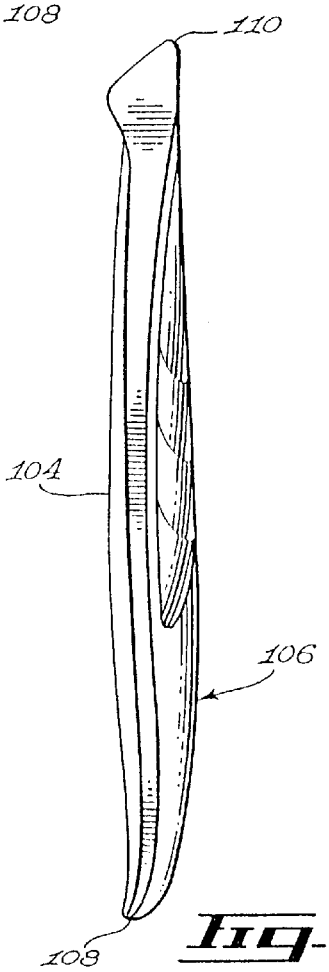
FIGS. 8 and 9 are an edge view and an top plan view respectively of the embodiment of FIG. 7.
Figure 9:
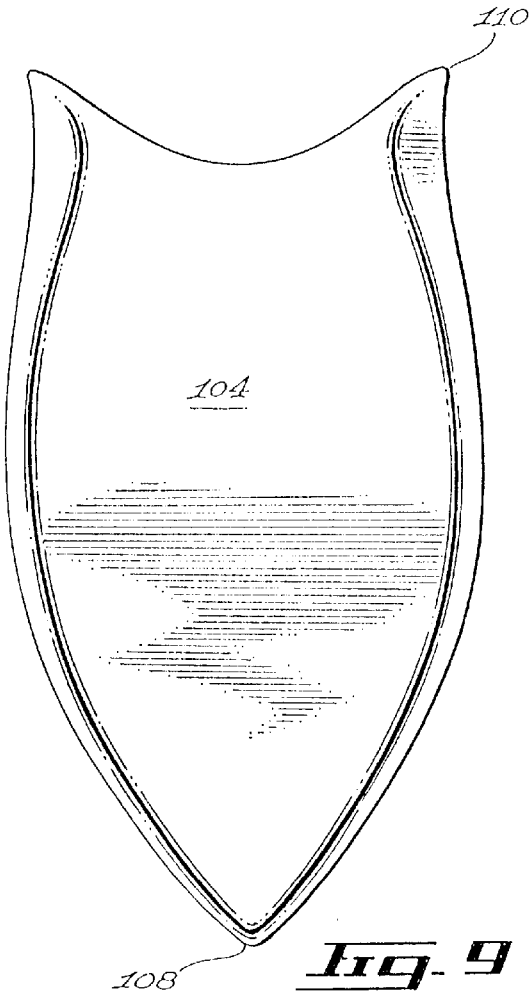
Figure 10:
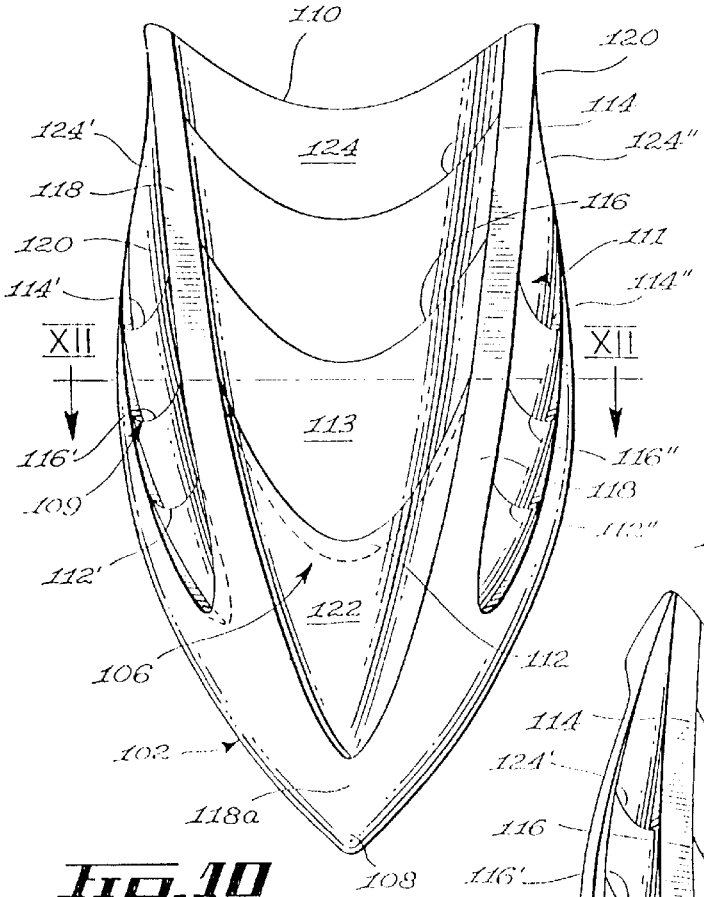
FIG. 10 is a bottom plan view of the surfboard of FIG. 7.
Figure 11:
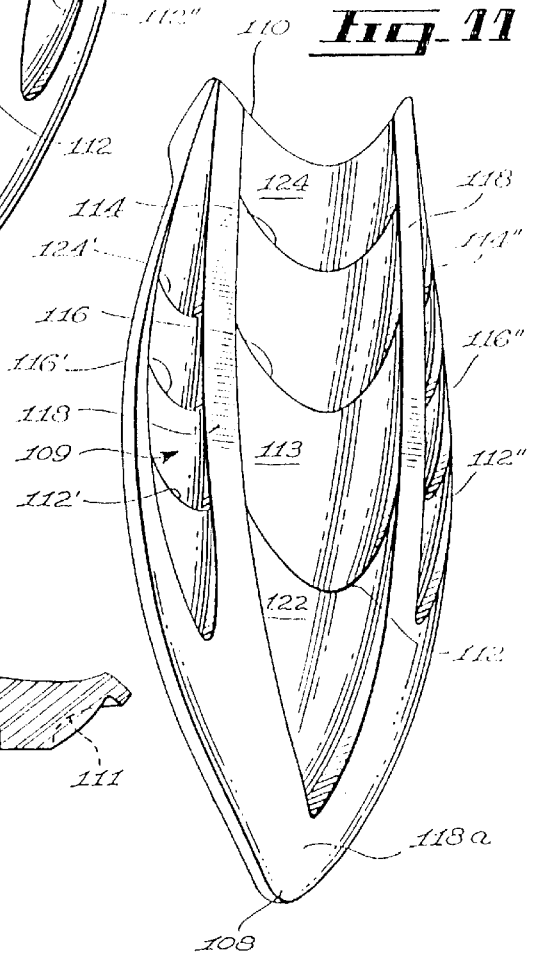
FIG. 11 is a perspective view of the hull of the surfboard of FIG. 7.

In the first embodiment of surfboard of the invention illustrated in FIGS. 1–6 of the drawings, there is provided an elongated body 2 made of buoyant material such as foam plastic, preferably covered with a skin of a rigid and impervious plastic material. The surfboard body 2 has a generally flat and smooth top surface 4 and a generally flat bottom surface 6 and is terminated by a front or bow end 8 and a rear or stern end 10.

The bottom surface 6 of the surfboard body 2 is provided by grooves which form a frontmost ridge 12, a rearmost ridge 14, intervening ridges 16 and longitudinal sides ridges 18. Ridges 12, 14 and 16 extend transversely of body 2 while ridges 18 extend longitudinally of body 2. Side ridges 18 have side faces 20 and frontmost ridge 12 defines a bow surface 22 which is convex in planes normal and parallel to surfaces 4 and 6. The rearmost ridge 14 defines a stern surface 24 with a convex profile normal to said bottom surface 6, adjacent the latter and of increasing inclination while approaching the top surface 4.

All of the ridges 12, 14 and 16 are bowed away from front end 8.

Ridges 14 and 16 have a front face 26 while ridges 12 and 16 have a back face 28. Faces 26 and 28 are the sides of the above-mentioned grooves which each is V-shaped and has an apex 30. Preferably, front faces 26 have a convex profile while back face 28 has a concave profile. Both faces are upwardly, forwardly inclined with respect to body 2. The exposed edge faces of ridges 12 to 18 collectively form bottom surface 6.

A central channel 32 is formed across each intervening ridge 16. Each channel 32 has a front flaring end 34. These several channels are in alignment with the longitudinal axis of the surfboard body 2.

A holding rope 36 is provided with a collar 38 at its outer end while its inner end is attached to a rope anchor 40 secured to the bow of body 2 centrally thereof.

The provision of the intervening ridges 16 and frontmost ridge 12 considerably increases the surface of the surfboard which is exposed to the incoming water flow, as compared to a conventional surfboard, in which only the stern surface 24 is so exposed. The rushing water enters the successive V-shaped grooves and impinges the back surfaces 28 and against the apices 30 causing not only forward movement of the surfboard through the water body but also a certain lifting effect on the surfboard in the water body.

The axial channels 32 enable the water to flow forwardly from one groove to the other in order to more uniformly distribute the forces exerted by the oncoming water on the surfboard body 2.

The transversely arcuate or bowed shape of the intervening ridges 24 and also of front ridge 12 deflects the oncoming water laterally inwardly towards the centre of the surfboard from each side thereof insuring directional stability of the surfboard.

In the alternate embodiment of the surfboard illustrated in FIGS. 7 to 12, corresponding elements relative to the first embodiment will be bear the same numerals but into a 100 series. Accordingly, this alternate embodiment of surfboard consists of an elongated body 102 made of buoyant material still having a generally flat and smooth top surface 104 and a generally flat but somewhat slightly convex bottom surface 106, and is terminated by a front or bow end 108 and a rear or stern end 110. Lateral side surfaces 109, 111, are formed on the opposite lateral side walls of the surfboard, transversely to the top and bottom side surfaces.

Figure 12:
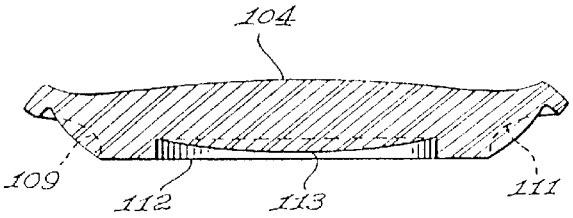
FIG. 12 is a cross-sectional view at a slightly enlarged scale, taken along line XII—XII of FIG. 10.

The bottom surface 106 of the surfboard body 102 is provided by a first set of grooves which form a frontmost ridge 112, a rear ridge 114, one or more intervening ridges 116 and longitudinal sides ridges 118. Ridges 112, 114 and 116 extend transversely of body 102, while ridges 118 extend generally longitudinally of body 102 but converging toward one another. Side ridges 118 have side faces 120 and merge at their front ends 118*a* at the bow end 108 of the watercraft. Frontmost ridge 112 defines a bow surface 122 which is convex. The rear ridge 114 defines a stern groove surface 124 with a convex profile normal to said bottom surface 106, at a distance from the latter and of increasing inclination while approaching the top surface 104, wherein a stern groove is formed which opens freely at the stern open end mouth. As illustrated in FIG. 12, the intermediate groove 113 located between ridges 112 and 116 is downwardly convex.

Lateral side surfaces 109, 111, of the surfboard are also provided with a second and a third set of grooves respectively which form a frontmost ridge 112', 112", a rearmost ridge 114', 114", and one or more intervening ridges 116', 116". Ridges 112', 112", 114', 114" and 116', 116" extend transversely of body 102. The rear ridges 114', 114", define a stern surface 124', 124", opening freely at a narrow stern end mouth thereof.

Again, all of the ridges 112, 112', 112", 114, 114', 114" and 116, 116', 116" are bowed away from front end 108, respectively. The exposed edge faces of ridges 112 to 118 collectively form bottom surface 106, while the grooves formed between the ridges of the lateral side surfaces 109, 111, form two water engaging pockets that converge toward one another at their front ends.

The lateral ridges located on the side pockets 109, 111, of the surfboard 102 increase the total water drag surface and can therefore further increase the watercraft speed at water level. Moreover, these lateral ridges 112', 114', 116', . . . assist in maintaining the surfboard axially aligned with the direction of displacement over water, i.e. substantially prevent the watercraft 102 from diverging relative to the axis of displacement thereof over water. Indeed, should the watercraft not be exactly orthogonal to the incoming waves on the water surface, or alternately parallel thereto depending on the choice of direction of the user, in a stationary condition thereof over water, upon forward motion of the surfboard 102, the lateral ridges will provide self-induced straightening of the watercraft. That is to say, the surfboard will automatically pivot under hydrodynamic forces to bring it exactly orthogonal to the waves, or exactly parallel thereto as the case may be.

I claim:

1. A surfboard comprising an elongated buoyant body having top, bottom, and opposite one and another lateral side surfaces, a longitudinal axis and a front and rear end, said body having a first set of arcuate transverse ridges formed by cavities made in said bottom surface, said ridges including a frontmost ridge, a rearmost ridge and intervening ridges, all of said ridges being frontwardly convex, symmetrical relative to said longitudinal axis and spaced one from the other longitudinally of said body, said ridges each having a frontmost leading face;

characterized in that each one of said intervening ridges is formed with a transverse channel extending across said frontmost leading face, said channels being coextensively aligned along said longitudinal axis;

each successive pair of said cavities opening in liquid communication with each other through said transverse channel of the corresponding adjacent one of said intervening ridges, said frontmost ridge closing the front end of the frontmost one of said cavities and said rearmost ridge closing the rear end of the rearmost one of said cavities;

wherein said channels remain fully submerged below the water line in use of the board over a body of water.

2. A surfboard as defined in claim 1, wherein each said channel flares at its front end (34).

3. A surfboard as defined in claim 1, wherein each cavity is defined by said leading face of any given ridge (12, 14, 16 and 112, 114, 116) and by the back face of an adjacent preceding ridge, each cavity being of V-shaped cross-section, said leading and back faces being upwardly and frontwardly inclined.

4. A surfboard as defined in claim 3, wherein each said ridge leading face defines a substantially flat lower edge surface forming part of said bottom surface (6, 106).

5. A surfboard as defined in claim 4, wherein the apices of said cavities are substantially, equally downwardly spaced from said top surface (4, 104).

6. A surfboard as defined in claim 4, wherein said rearmost ridge (11) has a rear face (24) being adjacent to said bottom surface (6) and substantially normal thereto at the junction of said rearmost ridge with said bottom surface, said rearmost ridge being of increasing inclination while approaching said top surface (4), thus defining a rearwardly convex shape.

7. A surfboard as defined in claim 4, wherein said frontmost ridge leading face forms the bow surface (22, 118*a*) of said body, said bow surface being convex in planes normal and parallel to said top and bottom surfaces.

8. A surfboard as defined in claim 4, wherein said one and another lateral side surfaces are each provided with a longitudinal ridge (18, 18 and 118, 118) having a lower surface merging with the lower edge surface of said transverse ridges, said longitudinal ridges merging with each other at said front end (8, 108) of the surfboard body.

9. A surfboard as defined in claim 1, wherein each said transverse ridge of said first set of ridges (12, 14, 16, 112, 114, 116) has a lower edge, sail one and another lateral side surfaces (109, 111) being each provided with a longitudinal ridge (18, 18 and 118, 118) having a lower surface merging with the lower edge of said first set of transverse ridges, said longitudinal ridges merging with each other at said front end (8, 108) of the surfboard body (2, 102).

10. A surfboard as defined in claim 9, wherein said rearmost ridge (14) has a rear face (24) being adjacent to said bottom surface (6) and substantially normal thereto at the junction of said rearmost ridge (14) with said bottom surface (6), said rearmost ridge being of increasing inclination while approaching said top surface, thus defining a rearwardly convex shape.

11. A surfboard as defined in claim 9, wherein said frontmost ridge leading face forms the bow surface (22, 118*a*) of said body, said bow surface being convex in planes normal and parallel to said top and bottom surfaces.

12. A surfboard comprising an elongated buoyant body-having top, bottom, and opposite one another lateral side surfaces, a longitudinal axis and a front and rear end, said body having a first set of arcuate transverse ridges formed by grooves in said bottom surface, said ridges including a frontmost ridge, a rearmost ridge and intervening ridges, all of said ridges being frontwardly convex, symmetrical relative to said longitudinal axis and spaced one from the other longitudinally of said body, said ridges each having a frontmost leading face;

wherein each said transverse ridge of said first set of ridges has a lower edge, said one and another lateral side surfaces being each provided with a longitudinal ridge having a lower surface merging with the lower edge of said first set of transverse ridges, said longitudinal ridges merging with each other at said front end of the surfboard body;

further including a second and a third set of arcuate transverse ridges formed by grooves made in said one and another side surfaces respectively, said ridges of the second and third set including a frontmost ridge, a rear ridge and at least one intervening ridge, all of said ridges bowed away from said front end, and spaced one from the other longitudinally of said body, said ridges of the second and third set having an exposed edge face forming part of said one and another lateral side surfaces respectively, said frontmost ridges of the second and third set of ridges arcuately converging toward one another but extending short of said longitudinal ridges merging at the front end of the surfboard body.

13. A surfboard as in claim 12, wherein each groove of said side surfaces is defined by the leading face of any given ridge and by the back face of an adjacent preceding ridge, each groove being of V-shaped cross-section; a groove further rearwardly depending from said rearmost ridges of each of said first, second and third sets of arcuate transverse ridges, wherein three coextensive groove mouths are defined at the rear end of the surfboard body.

14. A surfboard comprising an elongated buoyant body having top, bottom and opposite one and another lateral side surfaces, a longitudinal axis and a front and a real end, said body having a first set of arcuate, transverse ridges formed by grooves in said bottom surface, said ridges including a frontmost ridge, a rearmost ridge and intervening ridges, all of said ridges being frontwardly convex, symmetrical relative to said longitudinal axis and spaced one from the other longitudinally of said body, said ridges each having a frontmost leading face defining a lower edge; characterized in that said side surfaces are each provided with a longitudinal ridge having a lower edge, the lower edges of said longitudinal ridges merging with the lower edges of said frontmost, rearmost and intervening ridges, said longitudinal ridges of said side surfaces merging at said front end of the surfboard body;

and further including a second and a third set of arcuate transverse ridges formed by grooves made in said one and another side surfaces respectively, said ridges of the second and third set including a frontmost ridge, a rearmost ridge and at east one intervening ridge, all of said ridges being frontwardly convex and spaced one from the other longitudinally of said body, said frontmost ridges of the second and third set of ridges arcuately converging toward one another but extending short of said longitudinal ridges merging at the front end of the surfboard body.

* * * * *

UNITED STATES PATENT AND TRADEMARK OFFICE

CERTIFICATE OF CORRECTION

PATENT NO. : 6,007,393
DATED : December 28, 1999
INVENTOR(S) : Gilles Choiniere, et. al.

It is certified that error appears in the above-identified patent and that said Letters Patent is hereby corrected as shown below:

Title page, item [73], Assignee: should read –9063-8198 Quebec Inc.--

Signed and Sealed this

Twenty-first Day of November, 2000

*Attest:*

Q. TODD DICKINSON

*Attesting Officer*

*Director of Patents and Trademarks*